US011399648B2

(12) United States Patent
Lewis

(10) Patent No.: US 11,399,648 B2
(45) Date of Patent: Aug. 2, 2022

(54) GARAGE DOOR PARCEL RECEPTACLE

(71) Applicant: John D. Lewis, Jacksonville, FL (US)

(72) Inventor: John D. Lewis, Jacksonville, FL (US)

( * ) Notice: Subject to any disclaimer, the term of this patent is extended or adjusted under 35 U.S.C. 154(b) by 3 days.

(21) Appl. No.: 17/069,382

(22) Filed: Oct. 13, 2020

(65) Prior Publication Data

US 2022/0079365 A1 Mar. 17, 2022

Related U.S. Application Data

(60) Provisional application No. 62/913,727, filed on Oct. 10, 2019.

(51) Int. Cl.
*A47G 29/124* (2006.01)
*A47G 29/22* (2006.01)

(52) U.S. Cl.
CPC ..... *A47G 29/1248* (2017.08); *A47G 29/1245* (2013.01); *A47G 29/22* (2013.01); *A47G 2029/1257* (2017.08)

(58) Field of Classification Search
CPC ..... A47G 29/1248; A47G 29/1245; A47G 29/12; A47G 29/126; A47G 29/20; A47G 29/14; A47G 29/124; A47G 29/22; A47G 2029/1257; A47G 2029/149; E06B 7/32; E05G 7/00; E05G 7/008
USPC ..... 232/22, 19, 43.4, 43.5, 44, 45; 109/19, 109/66
See application file for complete search history.

(56) References Cited

U.S. PATENT DOCUMENTS 3,698,143 A * 10/1972 Francis ..... A47G 29/14 52/29
4,084,518 A * 4/1978 Carlson ..... E06B 7/32 109/19
4,135,658 A * 1/1979 Hagberg ..... E05G 7/008 232/43.1
4,245,776 A * 1/1981 Miner ..... E06B 7/32 232/43.3
4,596,358 A * 6/1986 Hagberg ..... A47G 29/14 232/43.1
4,640,200 A * 2/1987 Richardson ..... E06B 7/32 109/19
4,800,822 A * 1/1989 Adkins ..... A47B 55/00 109/19
5,029,753 A 7/1991 Hipon
(Continued)

*Primary Examiner* — William L Miller
(74) *Attorney, Agent, or Firm* — Marks Gray, P.A.; Mitchell Ghaneie

(57) ABSTRACT

The present invention relates to a parcel receptacle device that allows for securely receiving packages and transferring the packages to the interior side of a wall or door which the parcel receptacle device is attached. This device is comprised of a plurality of elements including an interior mounting plate, an exterior mounting plate, a housing and a drawer. The housing and drawer may be detached from an interior mounting plate that is affixed to the wall or door. This device also provides an auto-locking door that automatically closes when the housing and drawing are detached. Accordingly, the auto-locking door securely closes the opening in the garage door, which previously allowed the drawer to slide through. The receptacle can later be reattached by unlocking the auto-locking door and then raising it upward. Once it is raised up to a pre-determined position, the housing and drawer may then be reattached to the interior mounting plate.

26 Claims, 13 Drawing Sheets

(56) References Cited

U.S. PATENT DOCUMENTS 5,205,224 A * 4/1993 Durst ..... E05G 7/008 109/19
5,492,272 A 2/1996 Fewer
5,615,624 A * 4/1997 Terry ..... E05G 7/008 109/19
5,799,589 A * 9/1998 Clark ..... E05G 7/008 109/19
5,802,991 A * 9/1998 Brown ..... E05G 7/008 109/19
5,897,053 A 4/1999 Cirimele
5,897,054 A * 4/1999 Firth ..... E06B 7/32 232/44
6,302,325 B1 * 10/2001 Alexander ..... E05C 7/002 109/68
6,378,769 B1 * 4/2002 Wolgamot ..... E06B 7/32 109/68
6,588,655 B2 * 7/2003 Stapleton, Jr. ..... E06B 7/32 109/68
6,598,546 B2 * 7/2003 Alexander ..... E06B 7/28 109/67
7,182,243 B2 2/2007 Plappert
7,240,823 B1 7/2007 Saidiazar
7,721,660 B1 * 5/2010 Davis ..... E05G 7/008 109/19
9,016,558 B2 * 4/2015 Alexander ..... E06B 7/32 232/43.1
9,371,681 B2 6/2016 Tompkins
9,963,930 B1 * 5/2018 Reisender ..... E06B 7/32
10,045,648 B1 8/2018 Epstein et al.
10,093,454 B1 10/2018 Kalyan et al.
10,413,106 B1 * 9/2019 Valeriano ..... E06B 7/32
10,487,571 B2 * 11/2019 Humma ..... E05B 65/0864
10,512,351 B1 * 12/2019 Valeriano ..... E05B 47/0001
10,588,439 B2 * 3/2020 Charbeneau ..... A47G 29/22
10,588,440 B1 * 3/2020 Kajgana ..... A47G 29/28
10,881,233 B1 * 1/2021 Walsh ..... E06B 7/28
11,085,234 B2 * 8/2021 Hunt ..... A47G 29/124
2008/0000401 A1 * 1/2008 Weaver ..... E05G 7/008 109/19
2017/0143146 A1 * 5/2017 Charbeneau ..... A47G 29/141
2017/0295980 A1 * 10/2017 Willcox ..... A47G 29/141
2018/0199745 A1 * 7/2018 Charbeneau ..... A47G 29/22
2018/0317687 A1 11/2018 Crooks
2019/0345758 A1 * 11/2019 Drost ..... E06B 7/32
2020/0154922 A1 * 5/2020 Jeffs ..... A47G 29/20
2021/0005033 A1 * 1/2021 Roman ..... G07C 9/00896
2021/0059456 A1 * 3/2021 Fontanilla ..... A47G 29/141
2021/0079720 A1 * 3/2021 Hunt ..... E06B 7/32
2021/0106160 A1 * 4/2021 Janas ..... A47G 29/141
2021/0363816 A1 * 11/2021 Daniels ..... E06B 7/34

* cited by examiner

GARAGE DOOR PARCEL RECEPTACLE

CROSS-REFERENCE TO RELATED APPLICATIONS

This application claims priority of U.S. patent application Ser. No. 62/913,727, filed on Oct. 10, 2019.

BACKGROUND OF THE INVENTION

A. Field of the Invention

This invention relates to a parcel receptacle device that is installed in a wall or door, including a garage door, of a home or building.

B. Prior Art

Consumers are increasingly ordering more packages to be delivered to their residence and/or business. However, thieves have taken advantage of the increasingly popular deliveries by following delivery trucks, or simply waiting in or near neighborhoods for packages to be delivered. When the package is placed at the front of the residence, a thief may then walk up to the residence and steal the unsecured package. While there has been much innovation to deter theft of delivered packages, the problem persists.

The present device aims to solve this issue, by providing a device that may be attached to, and detached from, a garage door. When the device is attached, it can securely accept multiple packages throughout the day and place those packages inside the garage or home. The present device also provides an auto-locking door that automatically, and securely, closes the opening in the garage door, when the drawer and housing of the device are detached.

BRIEF SUMMARY OF THE INVENTION

The present application is for a parcel receptacle device that provides a drawer and housing that may be attached, and detached, from a wall or a door, including a garage door. When the parcel receptacle is attached to a garage door, it allows for one or more packages to be securely delivered by opening the drawer, inserting the package(s) into the drawer, and closing the drawer. As the drawer slides into a closed position, a drop-door in the floor of the drawer opens and allows the one or more packages to fall onto the interior floor of the garage or building whereby it is secure and hidden from public view. A housing opening is provided by the housing which allows for the drawer's drop-door to open and close.

To allow for the drawer and housing to be attached and detached, an interior mounting plate and exterior mounting plate are affixed to the garage door. The interior and exterior mounting plates each provide an opening for the drawer to slide through. The exterior mounting plate additionally provides a camera, and a doorbell to assist in deterring individuals from tampering with the device as well as notifying the recipient when a package has been delivered. The interior mounting plate provides a plurality of attachment points that allow for the drawer and housing to be attached and detached from the garage door. When the drawer and housing are detached, the interior mounting plate provides an auto-locking door, which automatically closes and locks to secure the opening in the garage door. The auto-locking door is pivotally attached to the interior mounting plate and can pivot to an open position when the housing and drawer are to be reattached to the garage door.

NUMBERING REFERENCE

1—Garage door
5—Parcel receptacle device
10—Drawer
12—Drop-door hinge
15—Drop-door
16—Plurality of rollers
17—Handle
18—Plurality of counterweights
19—Drawer opening
20—Housing
21—Housing opening
22—Plurality of roller tracks
23—Plurality of bottom mounting pin receivers
24—Plurality of top mounting pins
25—Exterior mounting plate
26—Camera
27—Doorbell

30—Interior mounting plate
31—Auto-locking door
32—Plurality of latch pins
33—Plurality of mounting pin holders
34—Hinge
34*a*—Hinge spring
50—Alternative exterior mounting plate
50*a*—Exterior side
50*b*—Interior side

DETAILED DESCRIPTION OF THE EMBODIMENTS

The presently described invention is a parcel receptacle device 5, hereinafter referred to as the device 5, that can be installed on a wall or door of a structure such that it may accept one or more delivered packages on one side of the wall or door and securely transfer the package(s) to other side of the wall or door. This device 5 is comprised of a drawer 10 that is placed in a housing 20. The housing 20 is attached to the wall or door with at least one mounting plate.

Although the present device 5 will henceforth be described as being attached to a garage door 1, it is anticipated that it may also be used within a window or attached to any door or wall of a building.

First Exemplary Embodiment

Figure 1:
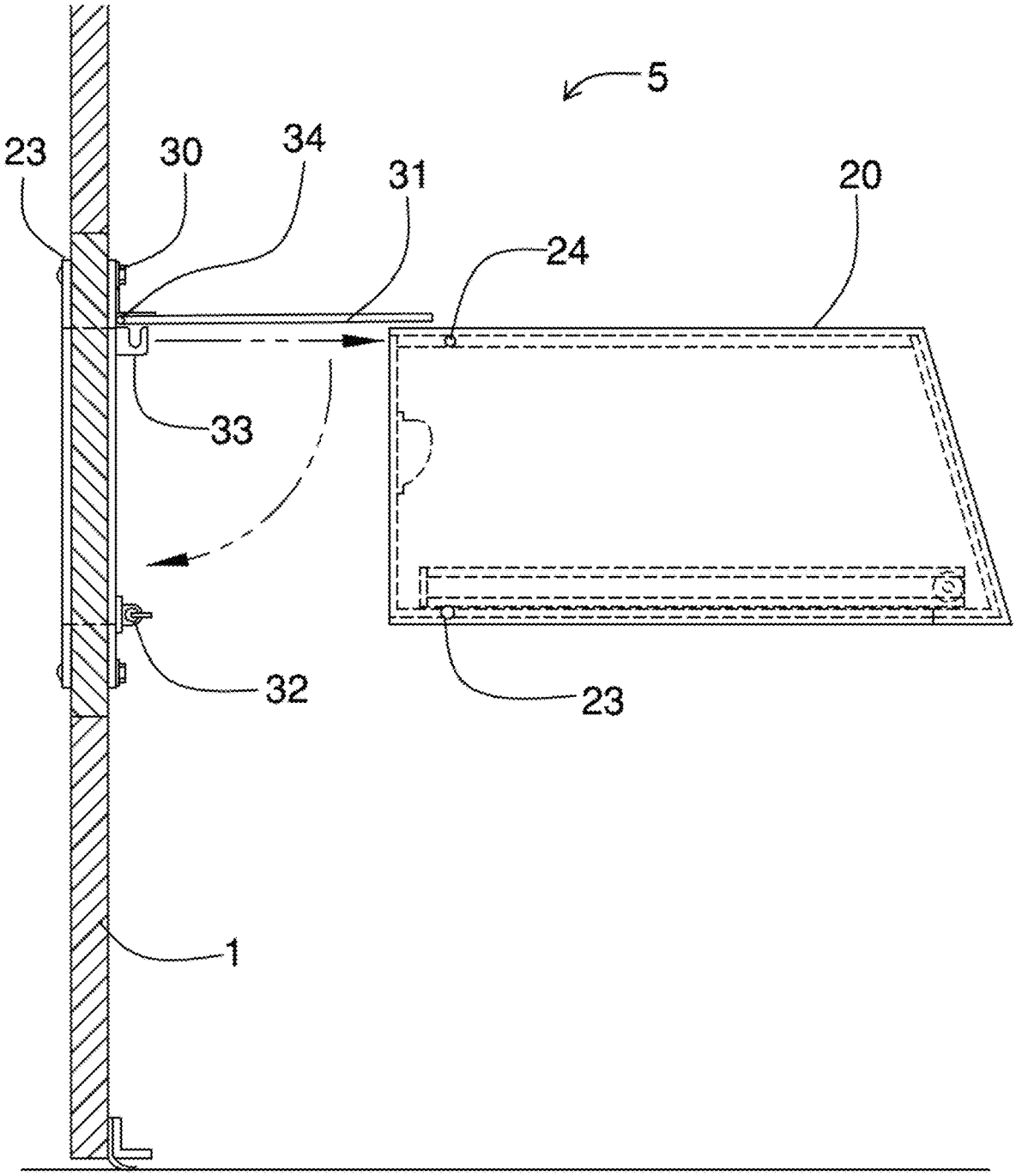
FIG. 1 is side view showing a garage door, a housing and a drawer disconnected from the garage door, an exterior mounting plate, an interior mounting plate, and an auto-locking door in an open position.
Figure 3:
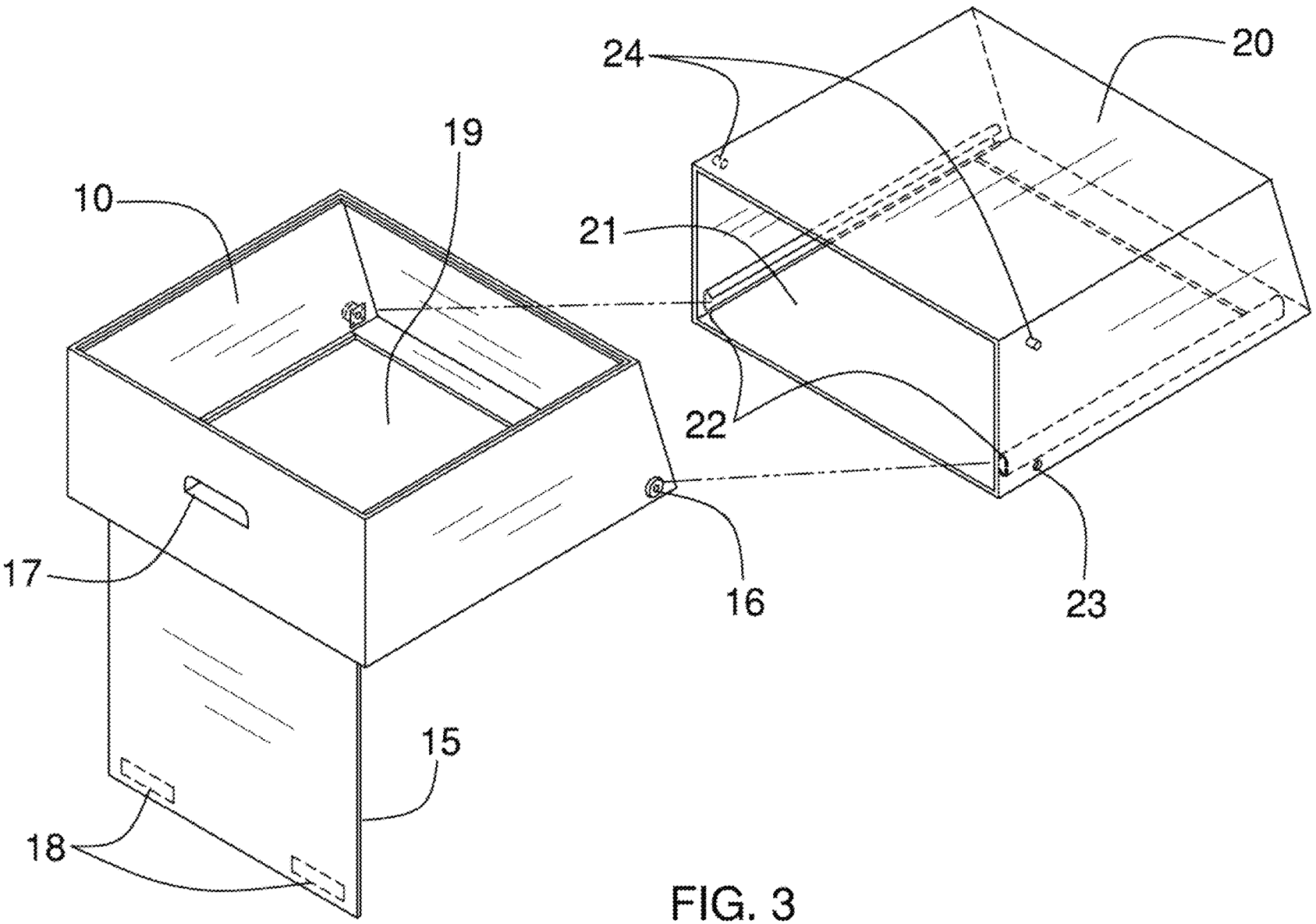
FIG. 3 is a front isometric view of the drawer and the housing.
Figure 4:
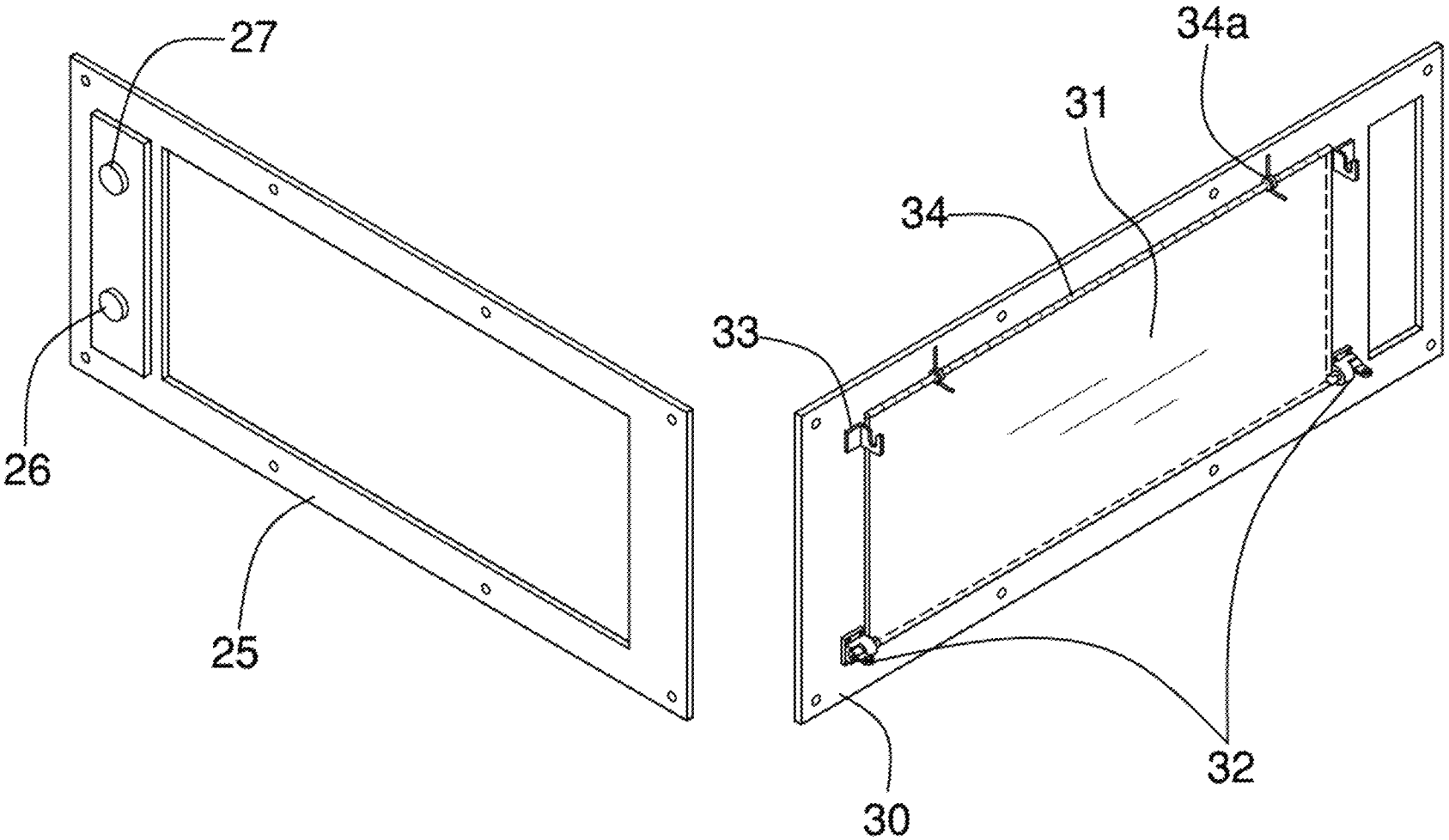
FIG. 4 is a front isometric view of the exterior mounting plate and the interior mounting plate showing the auto-locking door in a closed position and locked in place by a plurality of latch pins.
Figure 5:
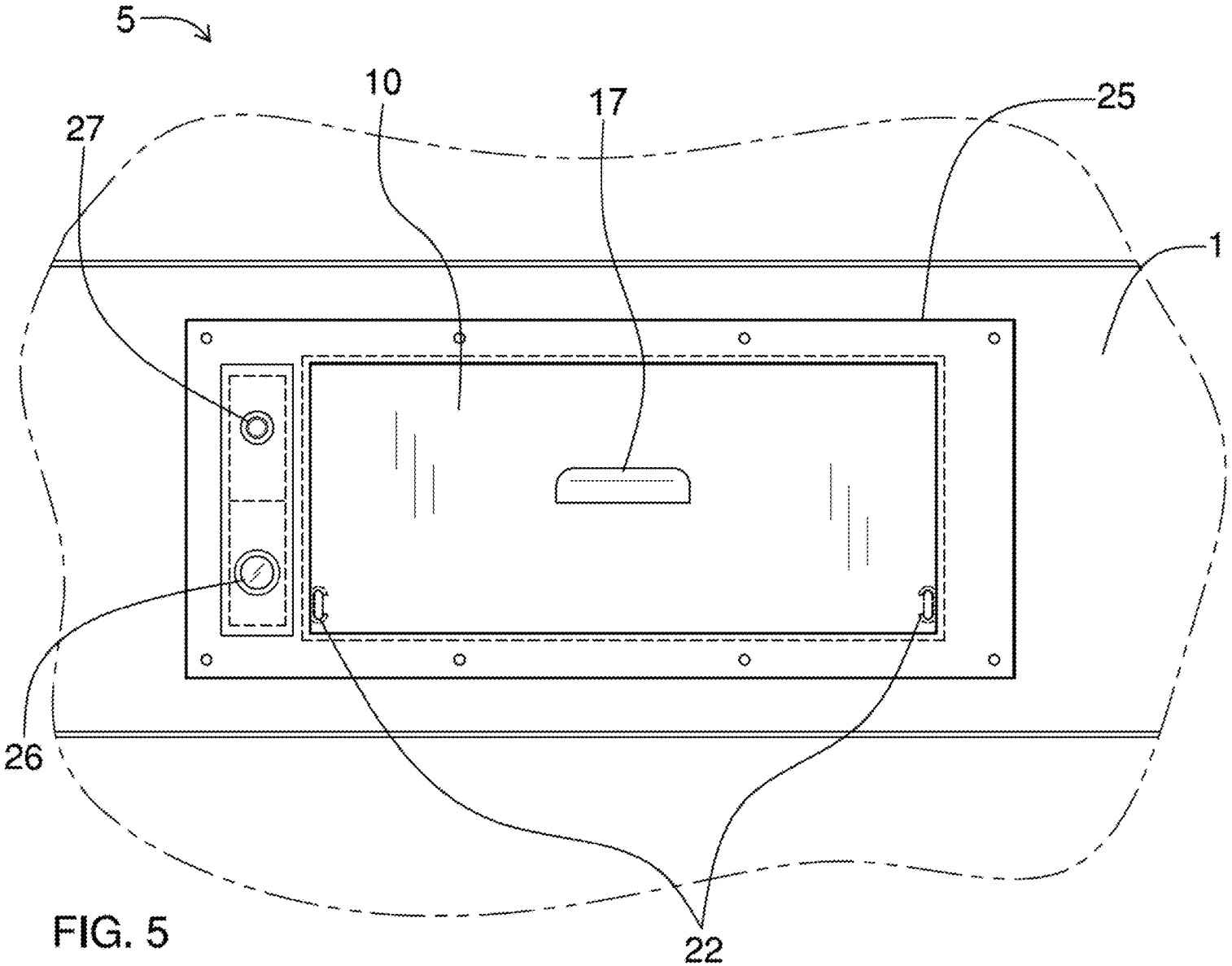
FIG. 5 is a front in-use view of the parcel receptacle device attached to the garage door.

A first exemplary embodiment of the device 5 provides an exterior mounting plate 25 and an interior mounting plate 30, as shown in FIG. 1. Referring to FIG. 3, the drawer 10 provides a plurality of rollers 16, a handle 17, a drawer opening 19, and a drop-door 15. The drop-door 15 is pivotally attached to the drawer 10 such that it is capable of opening and closing. The plurality of rollers 16 fit into, and roll within, the plurality of roller tracks 22 provided in the housing 20 to as assist the drawer 10 in translating, relative to the housing 20, between an open position and a closed position. In addition to the plurality of roller tracks 22, the housing 20 also provides a plurality of bottom mounting pin receivers 23, a plurality of top mounting pins 24, and a housing opening 21. The housing opening 21 allows the drop-door 15 to open and close without being obstructed by the housing 20.

Figure 6:
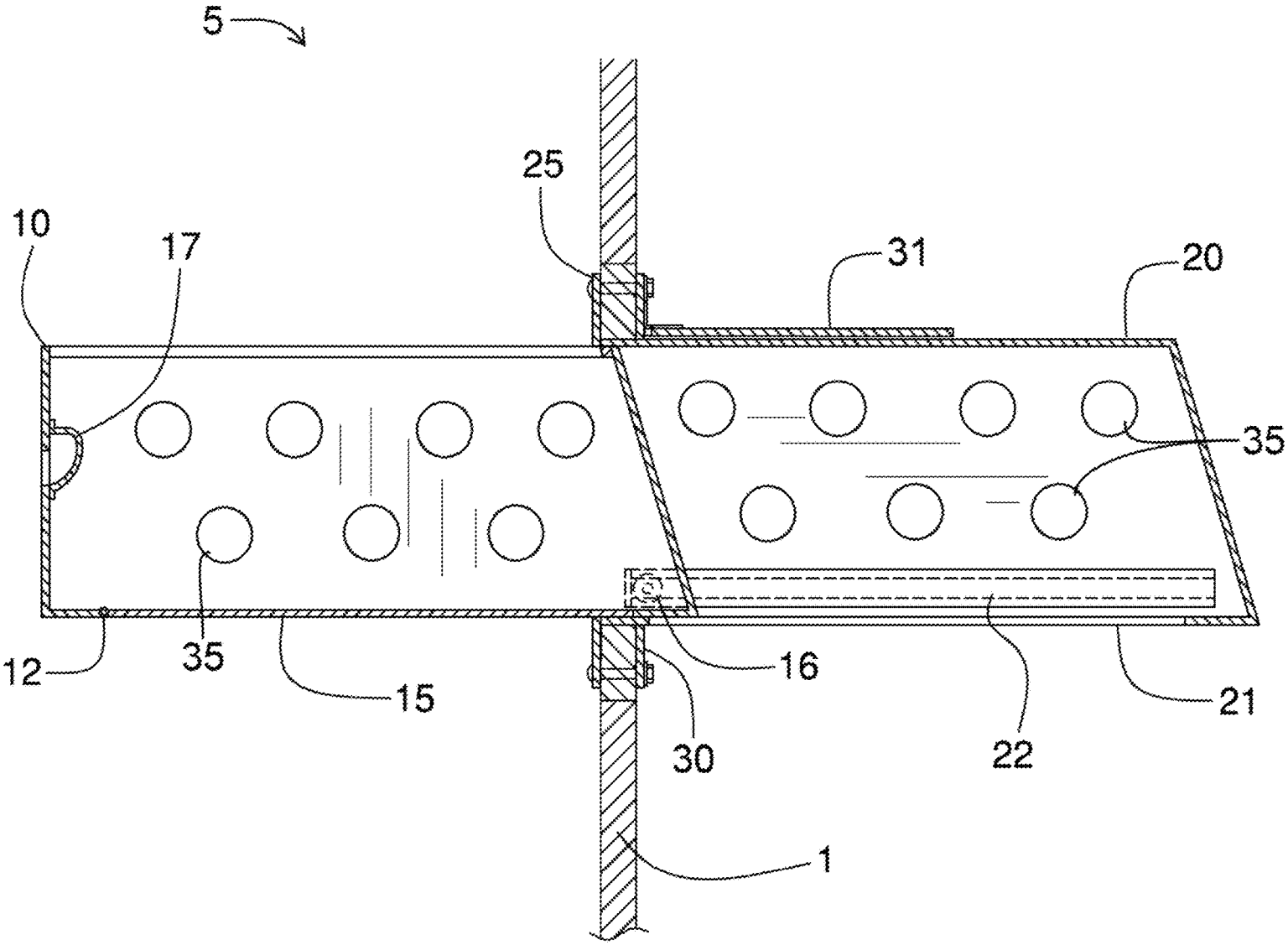
FIG. 6 is a cross-sectional view of the parcel receptacle device attached to the garage door showing the drawer in an open position.

It is anticipated for the housing 20 and drawer 10 to provide a plurality of cutouts 35 to reduce the overall mass and weight of the device 5, as shown in FIG. 6.

Figure 2:
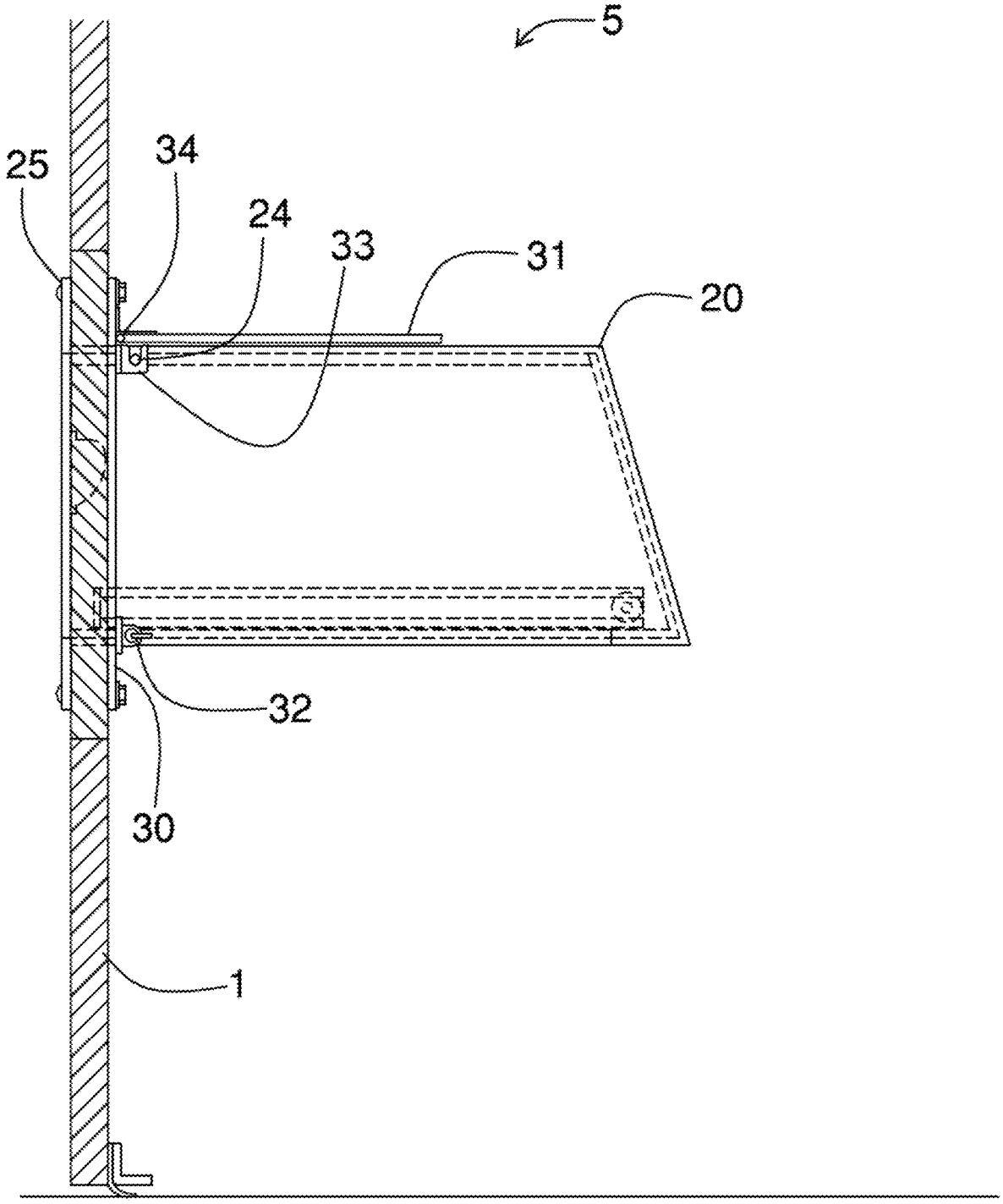
FIG. 2 is a side view showing the garage door, the housing and drawer connected to the garage door, the exterior mounting plate, the interior mounting plate, and the auto-locking door in an open position.

The garage door 1 has an exterior side and an interior side. The exterior mounting plate 25 is affixed to the exterior side of the garage door 1, and the interior mounting plate 30 is affixed to the interior side of the garage door 1, which is shown in FIG. 1 and FIG. 2. The exterior mounting plate 25 provides an exterior mounting plate opening, a camera 26, and a doorbell 27. It is anticipated that the camera 26 and the doorbell 27 may be linked wirelessly to an online network accessible by computer or mobile communication device. The exterior mounting plate opening has a width and height that are less than the width and height of the width and height of the housing 20.

The interior mounting plate 30 provides an interior mounting plate opening, an auto-locking door 31, a plurality of latch pins 32, a hinge 34, and a plurality of mounting pin holders 33 that cradle the plurality of top mounting pins 24. The interior mounting plate opening has a width and height that are substantially equal to or greater than the width and height of the housing 20. The hinge 34 further provides a hinge spring 34*a* which provides a rotational restoring force that assists the auto-locking door 31 to pivot about the hinge 34 to a closed position. Upon substantially reaching the closed position, the plurality of latch pins 32 automatically lock and secure the auto-locking door 31 to prevent opening from the exterior side of the auto-locking door 31.

As FIG. 1 shows, when the auto-locking door 31 is rotated to an open position, it allows for housing 20 to attach to the interior mounting plate 30. The housing 20 is inserted into the interior mounting plate opening such that the plurality of top mounting pins 24 are supported by the plurality of mounting pin holders 33. Additionally, the plurality of latch pins 32 provided on the interior mounting plate, substantially align with, and are accepted by, the plurality of bottom mounting pin receivers 23. Accordingly, the plurality of latch pins 32 being inserted into the plurality of mounting pin receivers 23 allow for a secondary support for the housing 20 when it is attached to the interior mounting plate 30. The auto-locking door 31 further assists in stabilizing the housing 20 by providing as a counterweight for the housing 20 when the drawer 10 is open and assists in providing addition securement of the housing 20 to the interior mounting plate 30.

Figure 9:
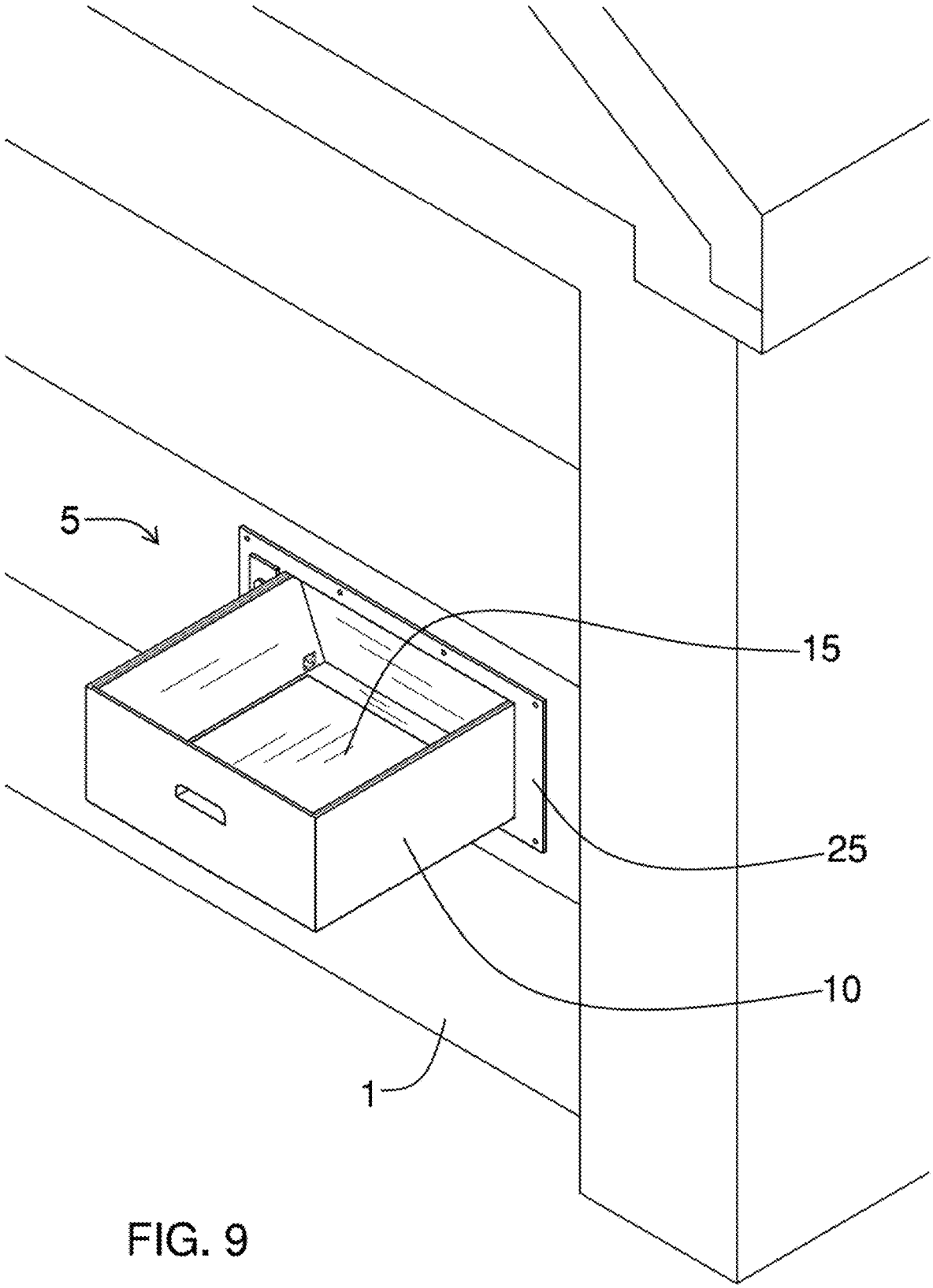
FIG. 9 is a front isometric in-use view of the parcel receptacle device showing the drawer in an open position.
Figure 10:
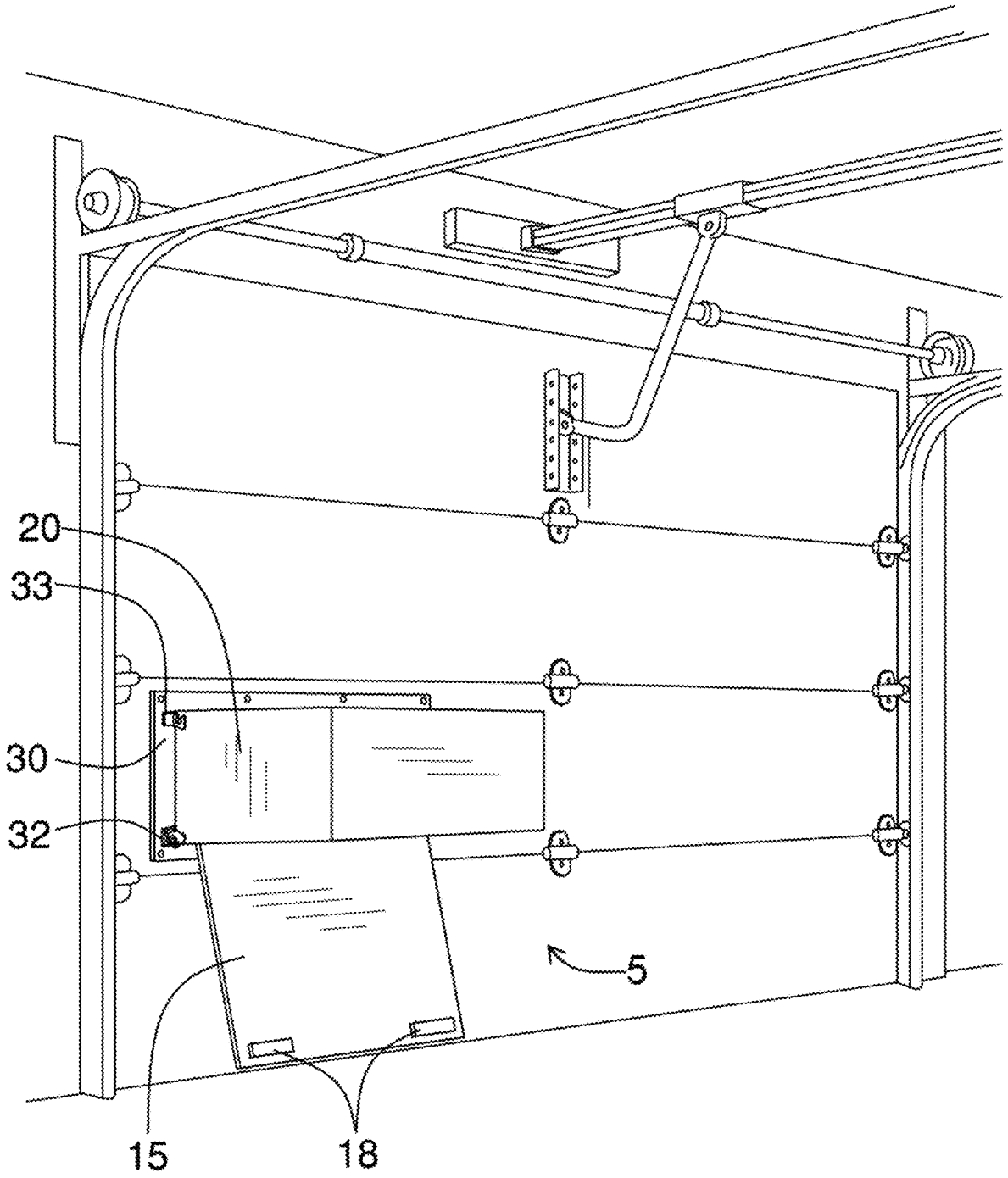
FIG. 10 is a rear isometric in-use view of the parcel receptacle device attached to the garage door showing the drawer in a closed position and the drop-door in an open position.

Once the housing 20 is attached to the interior mounting plate 30, the auto-locking door 31 is prevented from closing. Accordingly, the drawer 10, which can either be inserted into the housing 20 before or after the housing 20 is attached to the interior mounting plate 30, can translate to an open position when pulled by its handle 17. Once the drawer 10 is opened, as shown in FIG. 9, the package is placed on top of the drop-door 15.

Figure 7:
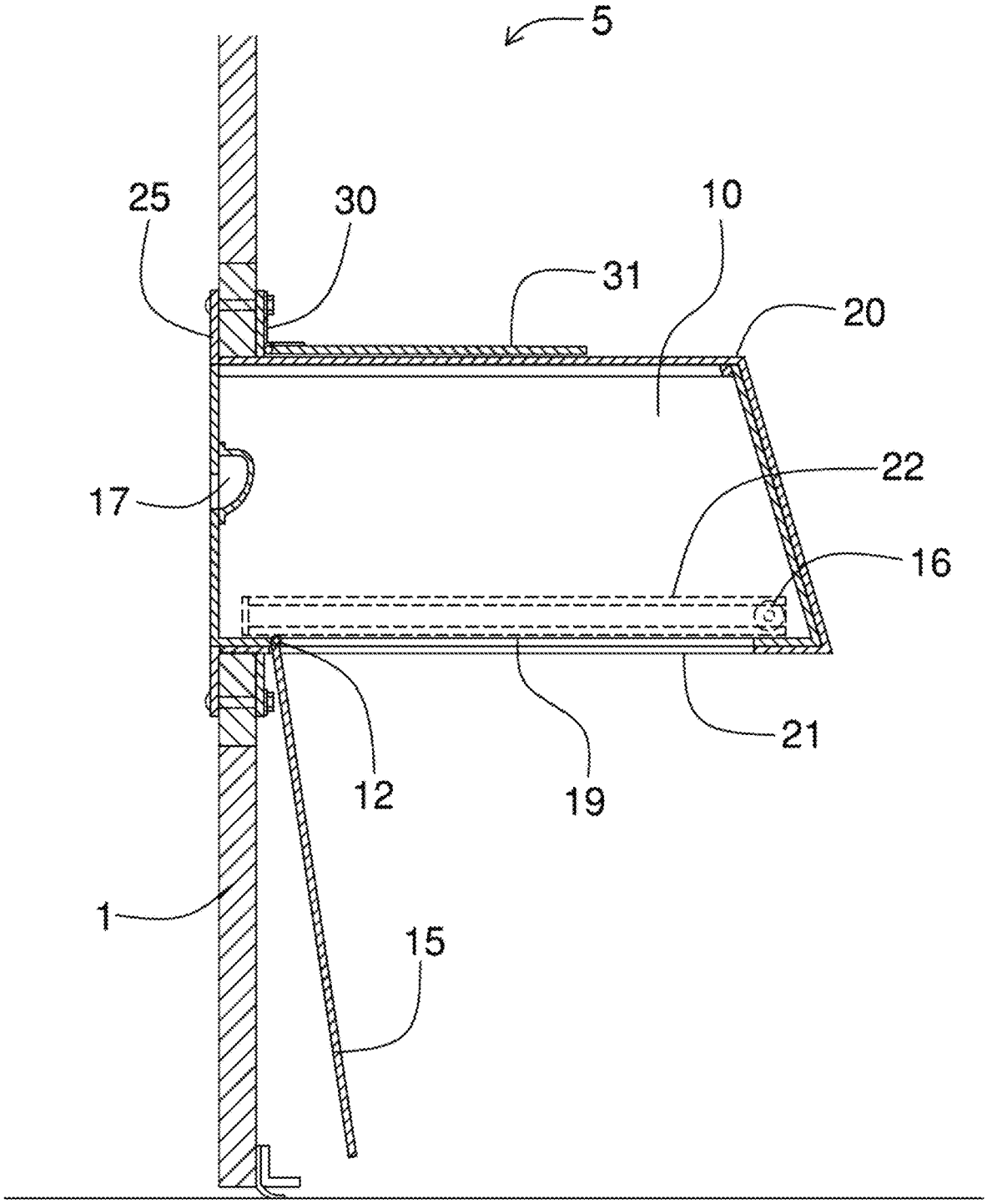
FIG. 7 is a cross-sectional view of the parcel receptacle device attached to the garage door showing the drawer in closed position and the drop-door in an open position.
Figure 8:
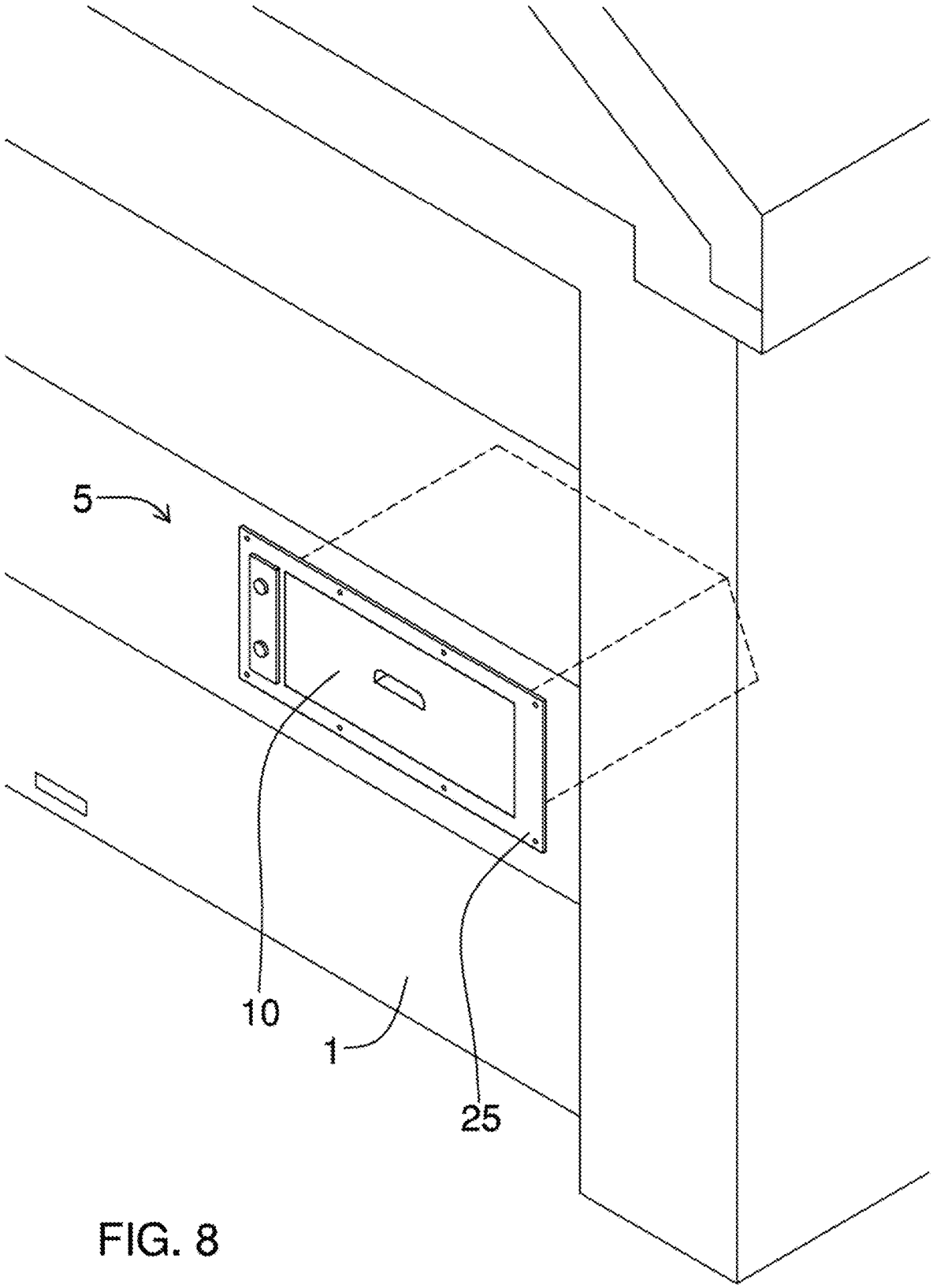
FIG. 8 is a front isometric in-use view of the parcel receptacle device attached to the garage door showing the drawer in a closed position.

After the package is placed on the drop-door 15, the drawer 10 can then translate towards a closed position within the housing 20. As the drawer 10 translates towards a closed position, the drop-door 15 begins to pivot about a drop-door hinge 12 due to the weight of the package. As the drop-door 15 pivots about the drop-door hinge 12, the drop-door 15 passes through the housing opening 21. The package, which was placed on top of the drop-door 15, eventually falls to the floor on the interior side of the garage door 1 once the inclination of the drop-door 15 is large enough to allow the package to fall to the floor. Once the package is released, the drawer 10 may be reopened to receive another package. Consequently, the device 5 cleverly and securely transfers one or more delivered packages from the exterior side of the garage door 1 to the interior side of the garage door 1 such that the package is out of view from potential thieves. It is anticipated, and shown in FIG. 3, that the drop-door 15 may provide a plurality of counterweights 18 to assist the drop-door 15 in opening as the drawer 10 translates towards a closed position within the housing 20. Additionally, it is anticipated that the drop-door 15 may be of comprised of a singular panel which is attached at the drop-door hinge 12, which is shown in FIG. 3 and FIG. 7; or, alternatively, is comprised of a plurality of panels wherein each panel of the plurality of panels is attached to one another with at least one single directional hinge (not shown).

In anticipation that the garage door 1 will likely be opened and closed, the housing 20 is designed to be removed from the interior mounting plate 30. When the housing 20 is detached from the interior mounting plate 30, the auto-locking door 31 pivots downward about the hinge 34 and the plurality of latch pins 32 engage the auto-locking door 31 such that it is locked in place. This allows for the garage door 1 to remain secure should the drawer 10 and housing 20 be detached from the interior mounting plate 30.

In order to reattach the housing 20 to the interior mounting plate 30, the plurality of latch pins 32 are required to be disengaged to allow the auto-locking door 31 to pivot upward, as shown in FIG. 1. Once the auto-locking door 31 is opened to a pre-determined position, the drawer 10 and housing 20 can then be reattached to the interior mounting plate 30.

Second Exemplary Embodiment

Figure 11:
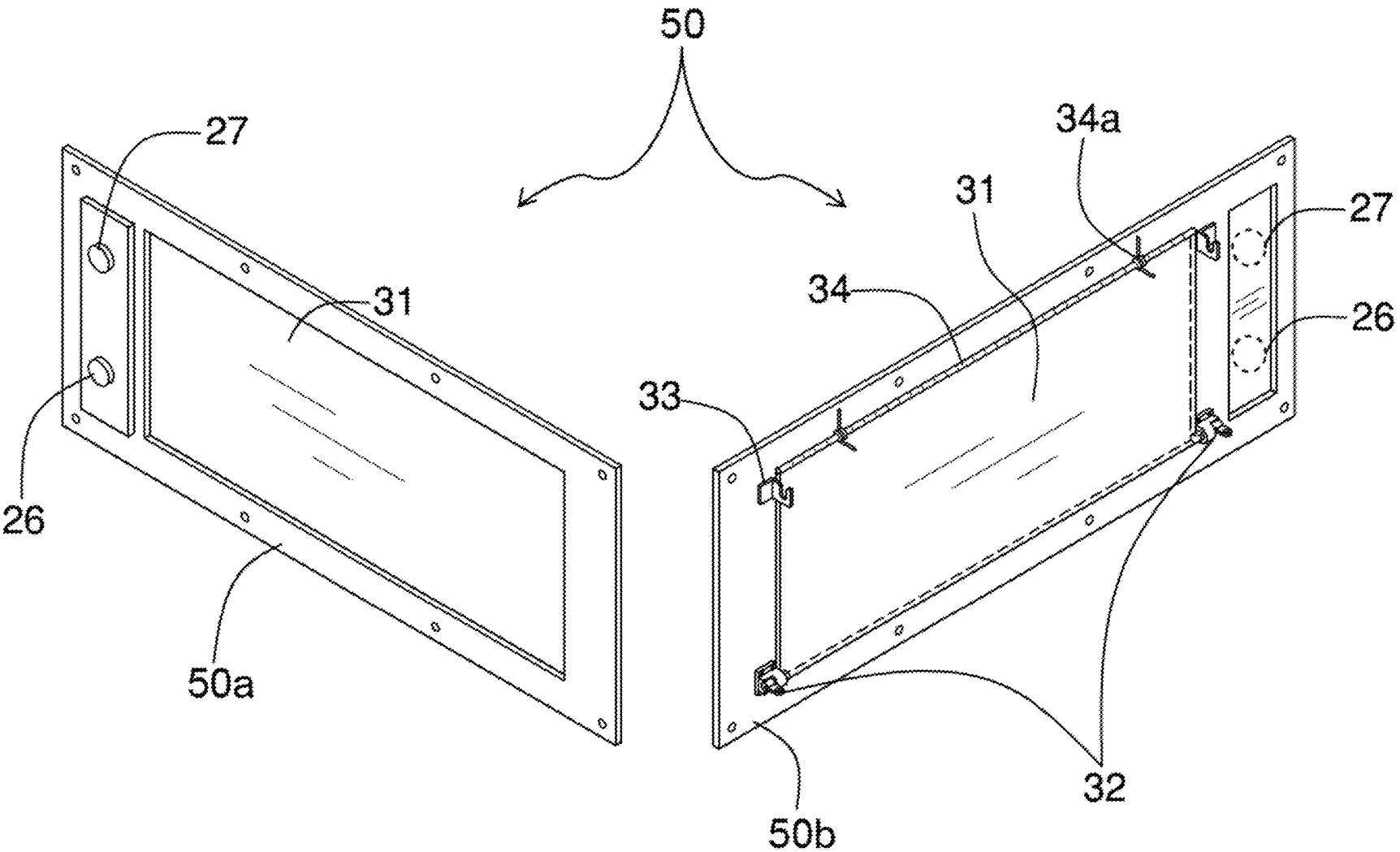
FIG. 11 is a front and rear isometric view of an alternative exterior mounting plate provided in a second exemplary embodiment of the parcel receptacle device.
Figure 12:
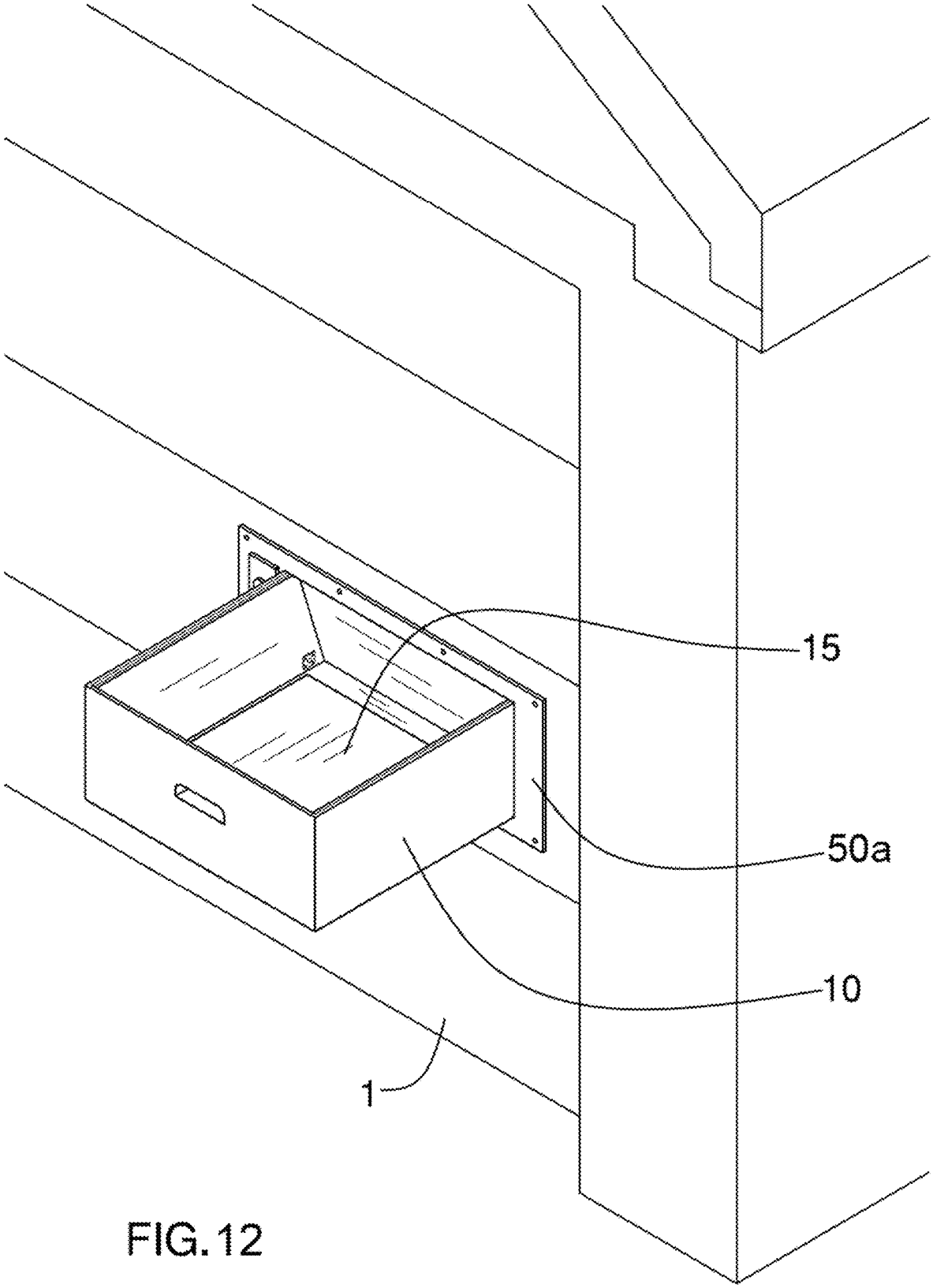
FIG. 12 is a front isometric in-use view of the second exemplary embodiment of the parcel receptacle device attached to the garage door showing the drawer in an open position.
Figure 13:
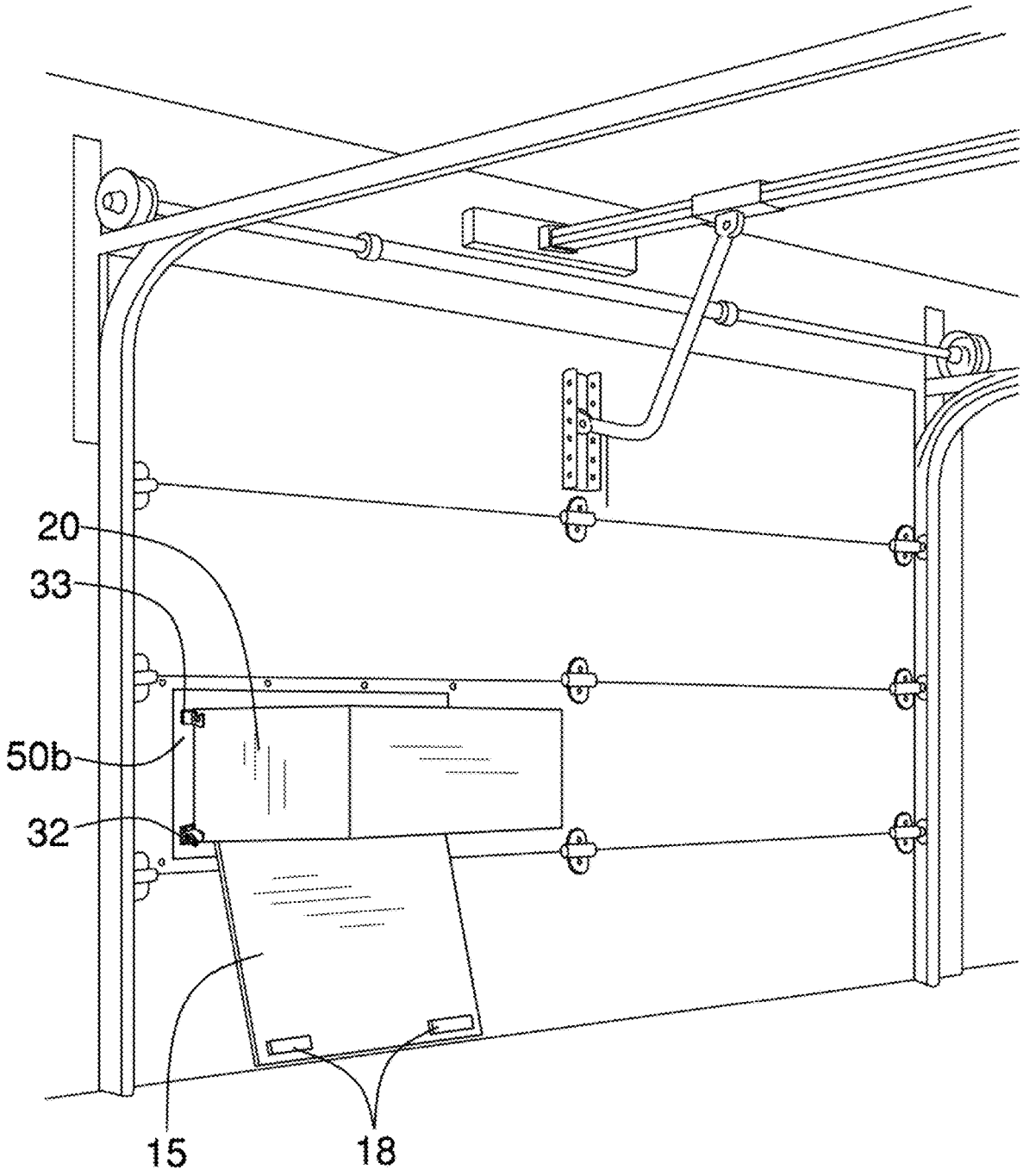
FIG. 13 is a rear isometric in-use view of the second exemplary embodiment of the parcel receptacle device attached to the garage door showing the drawer in a closed position and the drop-door in an open position.

A second exemplary embodiment of the present invention provides an alternative exterior mounting plate 50 and omits the required use of the interior mounting plate 30. The alternative exterior mounting plate 50 has an exterior side 50*a* and interior side 50*b*. The exterior side 50*a* provides the camera 26 and doorbell 27, and the interior side 50*b* provides the auto-locking door 31, the plurality of latch pins 32, and the plurality of mounting pin holders 33, as shown in FIG. 11. The housing 20 attaches to the interior side 50*b* of the alternative exterior mounting plate 50, as shown in FIG. 13.

The auto-locking door 31 is attached to the interior side 50*b* with a hinge 34 and hinge spring 34*a*. Accordingly, the auto-locking door 31 is raised prior to attachment of the housing 20 and is automatically and securely locked upon removal of the housing 20.

It is anticipated that the housing 20 and drawer 10 in the second exemplary embodiment may provide a plurality of cutouts 35 (not shown).

While the embodiments of the invention have been disclosed, certain modifications may be made by those skilled in the art to modify the invention without departing from the spirit of the invention.

The inventor claims:

1. A parcel receptacle device for installing on a structure, the parcel receptacle device comprising:

a. an exterior mounting plate;
  wherein the exterior mounting plate provides an exterior mounting plate opening;
b. an interior mounting plate;
  wherein the interior mounting plate provides an interior mounting plate opening;
  wherein the interior mounting plate provides a plurality of mounting pin holders;
  wherein the interior mounting plate provides a hinge;
  wherein the interior mounting plate provides an auto-locking door;
  wherein the auto-locking door is pivotally attached to the hinge;
  wherein the interior mounting plate provides a plurality of latch pins:
c. a housing;
  wherein the housing can be attached to and detached from the interior mounting plate;
  wherein the housing provides a plurality of top mounting pins;
  wherein the housing provides a plurality of bottom mounting pin receivers;
  wherein the housing provides a housing opening;
d. a drawer:
  wherein the drawer is capable of translating relative to the housing;
  wherein the drawer provides a drop-door hinge;
  wherein the drawer provides a drop-door;
  wherein the drop-door is pivotally attached to the drop-door hinge.

2. The parcel receptacle device of claim 1, wherein the exterior mounting plate provides a camera.

3. The parcel receptacle device of claim 2, wherein the camera is linked wirelessly to an online network accessible by computer or mobile communication device.

4. The parcel receptacle device of claim 1, wherein the exterior mounting plate provides a doorbell.

5. The parcel receptacle device of claim 4, wherein the doorbell is linked wirelessly to an online network accessible by computer or mobile communication device.

6. The parcel receptacle device of claim 1, wherein the hinge provides a hinge spring.

7. The parcel receptacle device of claim 1, wherein the drop-door provides a plurality of counterweights.

8. The parcel receptacle device of claim 1, wherein the drawer provides a plurality of rollers and the housing provides a plurality of roller tracks.

9. The parcel receptacle device of claim 1, wherein the drawer provides a handle.

10. The parcel receptacle device of claim 1, wherein the plurality of latch pins automatically lock the auto-locking door in a closed position when the housing is detached from the interior mounting plate.

11. The parcel receptacle device of claim 1, wherein the plurality of bottom mounting pin receivers accepts the plurality of latch pins.

12. The parcel receptacle device of claim 1, wherein the plurality of mounting pin holders accepts the plurality of top mounting pins.

13. The parcel receptacle device of claim 1, wherein the housing provides a plurality of cutouts.

14. A parcel receptacle device comprising:

a. an exterior mounting plate;
  wherein the exterior mounting plate provides an exterior mounting plate opening;
  wherein the exterior mounting plate provides an exterior side and an interior side;
  wherein the interior side provides a plurality of mounting pin holders;
  wherein the interior side provides a hinge;
  wherein the interior side provides an auto-locking door;
  wherein the auto-locking door is pivotally attached to the hinge;
  wherein the interior side provides a plurality of latch pins;
b. a housing;
  wherein the housing can be attached to and detached from the interior side of the exterior mounting plate;
  wherein the housing provides a plurality of top mounting pins;
  wherein the housing provides a plurality of bottom mounting pin receivers;
  wherein the housing provides a housing opening;
c. a drawer;
  wherein the drawer is capable of translating relative to the housing;
  wherein the drawer provides a drop-door hinge;
  wherein the drawer provides a drop-door;
  wherein the drop-door is pivotally attached to the drop-door hinge.

15. The parcel receptacle device of claim 14, wherein the exterior mounting plate provides a camera.

16. The parcel receptacle device of claim 15, wherein the camera is linked wirelessly to an online network accessible by computer or mobile communication device.

17. The parcel receptacle device of claim 14, wherein the exterior mounting plate provides a doorbell.

18. The parcel receptacle device of claim 17, wherein the doorbell is linked wirelessly to an online network accessible by computer or mobile communication device.

19. The parcel receptacle device of claim 14, wherein the hinge provides a hinge spring.

20. The parcel receptacle device of claim 14, wherein the drop-door provides a plurality of counterweights.

21. The parcel receptacle device of claim 14, wherein the drawer provides a plurality of rollers and the housing provides a plurality of roller tracks.

22. The parcel receptacle device of claim 14, wherein the drawer provides a handle.

23. The parcel receptacle device of claim 14, wherein the plurality of latch pins automatically lock the auto-locking door in a closed position when the housing is detached from the exterior mounting plate.

24. The parcel receptacle device of claim 14, wherein the plurality of bottom mounting pin receivers accepts the plurality of latch pins.

25. The parcel receptacle device of claim 14, wherein the plurality of mounting pin holders accepts the plurality of top mounting pins.

26. The parcel receptacle device of claim 14, wherein the housing provides a plurality of cutouts.

* * * * *